US008066832B2

(12) United States Patent
Aubé

(10) Patent No.: US 8,066,832 B2
(45) Date of Patent: Nov. 29, 2011

(54) DELAY COMPOSITIONS AND DETONATION DELAY DEVICE UTILIZING SAME

(75) Inventor: Réjean Aubé, Lachute (CA)

(73) Assignee: Orica Explosives Technology Pty Ltd, Melbourne (AU)

( * ) Notice: Subject to any disclaimer, the term of this patent is extended or adjusted under 35 U.S.C. 154(b) by 178 days.

(21) Appl. No.: 11/977,921

(22) Filed: Oct. 25, 2007

(65) Prior Publication Data

US 2008/0223242 A1 Sep. 18, 2008

Related U.S. Application Data

(62) Division of application No. 09/895,334, filed on Jul. 2, 2001, now abandoned.

(30) Foreign Application Priority Data

Mar. 9, 2001 (CA) ..... 2340523

(51) Int. Cl.
*C06B 45/10* (2006.01)
*C06B 45/02* (2006.01)
*F42C 19/12* (2006.01)

(52) U.S. Cl. ..... 149/19.2; 102/202.13; 102/202.5; 102/275; 149/21

(58) Field of Classification Search ..... 149/19.2, 149/21; 102/202.13, 202.5, 275
See application file for complete search history.

(56) References Cited

U.S. PATENT DOCUMENTS

| | | | | |
|---|---|---|---|---|
| 2,416,639 | A | | 2/1947 | Pearsall |
| 3,238,076 | A | | 3/1966 | Taylor et al. |
| 3,291,664 | A | | 12/1966 | Taylor et al. |
| 4,419,154 | A | | 12/1983 | Davitt et al. |
| 4,841,856 | A | | 6/1989 | Gisler et al. |
| 5,031,538 | A | | 7/1991 | Dufrane et al. |
| 5,147,476 | A | * | 9/1992 | Beck et al. ..... 149/37 |
| 5,654,520 | A | * | 8/1997 | Boberg et al. ..... 102/205 |
| 5,689,083 | A | | 11/1997 | Hadden |
| 5,945,627 | A | | 8/1999 | Arpin et al. |

FOREIGN PATENT DOCUMENTS

| | | |
|---|---|---|
| CA | 1145143 | 4/1983 |
| CA | 1150514 | 7/1983 |
| FR | 2642158 | 7/1990 |
| GB | 2089336 A | 6/1982 |
| GB | 2241946 A | 9/1991 |

* cited by examiner

*Primary Examiner* — Jerry A Lorengo
(74) *Attorney, Agent, or Firm* — Nixon & Vanderhye P.C.

(57) ABSTRACT

A delay composition for a detonator or delay device. The composition comprising a mixture of silicon and barium sulfate, and an amount of red lead in the range of about 3 to 15%, and preferably 6 to 12%, by weight of the mixture. The invention also relates to a delay element comprising a rigid metal tube containing the delay composition, and a delay device incorporating the delay element.

16 Claims, 8 Drawing Sheets

DELAY COMPOSITIONS AND DETONATION DELAY DEVICE UTILIZING SAME

CROSS REFERENCE TO RELATED APPLICATION

This application is a division of applicant's U.S. patent application Ser. No. 09/895,334, filed Jul. 2, 2001 now abandoned.

BACKGROUND OF THE INVENTION

I. Field of the Invention

This invention relates to delay compositions used in detonators for explosives (sometimes referred to as blasting caps) and other devices (e.g. inline detonation delay devices), and to detonation delay elements and devices containing such compositions. More particularly, the invention relates to delay compositions having slow-burning (long delay) times for use with both non-electric and electric detonators, inline delay devices, and the like.

II. Background Art

Delay compositions are materials that burn away rapidly, but not instantly, when ignited, thus create a timing delay, in the nature of a fuse, when shaped and compacted in the form of an elongated body or column and ignited at one end. Such compositions may therefore be used to create a delay between the instant at which a detonator or similar device receives a firing signal (which commences ignition of the column of delay composition), and the instant at which an associated explosive charge is set off (by heat when the combustion reaches the remote end of the burning column), or a further firing signal is generated.

Delay detonators and similar delay devices, both non-electric and electric, are widely employed in mining, quarrying and other blasting operations in order to permit sequential initiation of explosive charges distributed in a predetermined pattern of bore holes or shot holes. The provision of a delay between sequential initiation of adjacent bore or shot holes is effective in controlling the fragmentation and throw of the rock being blasted and, in addition, provides a reduction in ground vibration and in air blast noise.

Modern commercial delay detonators, whether non-electric or electric, normally comprise a metallic shell, closed at one end, which contains in sequence from the closed end: a base charge of a detonating high explosive, such as for example pentaerythritoltetranitrate (PETN), and an adjacent primer charge of a heat-sensitive detonable material, such as for example lead azide. Adjacent to the heat-sensitive material is a consolidated, e.g. compressed, column of delay composition of sufficient length and quantity to provide a desired delay time as described above. The column of the delay composition is normally confined within a hollow tubular confinement element made of metal. The confinement element and delay composition contained therein, together with sealers and primer charges, if any, form a delay element that is normally fabricated separately and assembled into a detonator or the like as a single item. Next to the delay element is an ignition (starter) charge adapted to be ignited by an electrically heated bridge wire or, alternatively, by the heat and flame of a low energy detonating cord or shock wave conductor retained in the open end of the metallic shell. Such a delay detonator may serve as an in-line delay as when coupled at both ends to a detonating cord or shock wave conductor. However, a delay device need not also be capable of serving as a detonator in order, for example, to initiate a shock wave conductor. An ignition charge in close proximity to the end of the shock wave conductor, instead of a base charge of detonating high explosive, will suffice.

The containment of the delay composition within a confinement element facilitates the handling of the composition and its introduction into a detonator or the like. The metal also protects other components (e.g. the outer shell of a detonator) from the heat and by-products of combustion as the delay composition is consumed and, for reasons of economy, minimizes the amount of the delay composition that is required. In the past, lead has often been used as the metal for the confinement elements. Lead is soft and malleable and can be loaded with a burning core, drawn to a desired diameter and cut to required lengths (different lengths produce different delay times). Lead also has a low thermal conductivity and heat capacity, and therefore diverts only a minimum amount of heat from the composition as it burns, thus reducing the risk that the combustion may be quenched or extinguished prior to complete consumption of the delay composition.

A trend has recently developed of replacing confinement elements made of lead with elements made of rigid metals, such as zinc, aluminum, steel or brass. Zinc is currently the preferred metal of choice for this purpose. The term "rigid metal" refers to those metals that, when used to form confinement elements, are not easily drawn to a desired diameter or shaped using the equipment currently available for lead. With such metals, the confinement elements are first cast to the desired diameter and length, and then the delay composition is loaded into the interior of the element and compressed. This change to rigid metal confinement elements has come about in part because the use of lead is receiving criticism from some quarters for being environmentally hazardous, even though the quantity of lead is small. Moreover, the use of rigid metal confinement elements can facilitate fabrication of delay units and their integration into detonators and delay devices, etc. However, zinc and other suitable rigid metals have higher thermal conductivities and heat capacities than lead, and thus extract more heat from the delay composition as it burns. This can increase the failure rate of detonators and delay devices because there may be insufficient heat remaining in the delay composition to maintain the combustion temperature until complete consumption of the composition has taken place, especially when such devices are used in low temperature environments. Particularly at risk of failure are delay units intended to provide long delays, e.g. more than one second, often used in underground applications.

A large number of delay compositions are known in the art. These generally comprise mixtures of fuels and oxidizers of various kinds. Many are substantially gasless compositions, which are generally preferred; that is, they burn without evolving large amounts of gaseous by-products which could interfere with the functioning of a delay detonator or other device. In addition to an essential gasless requirement, delay compositions are also required to be safe to handle, from both an explosive and health viewpoint, they must be resistant to moisture and not deteriorate over long periods of storage and hence change in burning characteristics, they must operate reliably over a wide range of temperatures, and they must be adaptable of use in a wide range of delay units within the limitations of space available inside a standard detonator shell or similar device. The numerous delay composition of the prior art have met with varying degrees of success in use and application.

One such prior class of delay compositions intended for use in confinement elements made of lead is that described in U.S. Pat. No. 4,419,154 to Davitt et al. (assigned to CXA Ltd/CXA LTEE) which issued on Dec. 6, 1983. This patent discloses a composition comprising silicon and barium sulfate and optionally including a proportion of particulate red lead (lead tetroxide, $Pb_3O_4$) in the amount of 25 to 75% by weight of the composition. The compositions of Davitt which include red lead can be used in confinement elements made of lead to produce intermediate to long timing delays. However, in order to achieve the long timing delays with red read, which is recognized as a strong oxidant, the Davitt compositions have to be prepared with coarse silicon. Such slow burning compositions are difficult to ignite due to the use of such coarse silicon that goes against traditional pyrotechnic principles as taught by Professor Conkling, who stated, in Chemistry of Pyrotechnics, John A. Conkling, Marcel Dekker Inc., 1985, pp 88-89:

"Homogeneity, and pyrotechnic performance, will increase as the particle size of the various components is decreased. The finer the particle size, the more reactive a particular composition should be, with all other factors held constant."

Furthermore the slow burning compositions of Davitt et al. with red lead were prepared with a very small ratio of the fuel component (i.e. silicon) which was significantly below the stoichiometric ratio, with the consequence of reducing the energy output of the combustion process. Such formulations would not be robust in various conditions, such as when used in rigid elements as herein described where the thermal conductivity of such confinement materials is significantly higher than lead. Furthermore, when Davitt et al. attempted to use finer silicon with red lead, which would have had the consequence of improving the pyrotechnic performance, significantly faster timing results were obtained (Column 8 of the patent). The only slow burning compositions of Davitt et al. that can be prepared with fine silicon are those without red lead. Thus, according to Davitt et al., compositions with red lead are not ideal for producing long timing delays. For long delay periods, there is therefore a need to find alternative delay compositions.

U.S. Pat. No. 5,147,476 to Beck et al. (assigned to Imperial Chemical Industries PLC), which issued on Sep. 15, 1992, addresses the problem of increasing the robustness of combustion of delay compositions intended for use in rigid metal confining elements to reduce the likelihood of quenching of the combustion. The concept of Beck et al. was to facilitate the combustion of a mixture of silicon and barium sulfate (or other oxidant) by adding small amounts of dispersed metal compounds to serve as reaction-facilitating fluxes (i.e. materials that lower the fusion temperature of the composition, but are otherwise inert). The illustrated metal compounds are salts of alkali metals, oxides of antimony and oxides of vanadium. Beck et al. found that for reliable burning of such a composition, the heat sink effect of the confinement metal element should not be such as to risk quenching of the exothermic reaction (i.e. burning) of the delay composition. However, the delay compositions of the kind disclosed by Beck et al. do not work as well as might be desired, particularly when used for producing long delays. Moreover, the oxides used in these compositions as fluxes are expensive. Beck et al. suggested that additions of red lead oxide or other reactive ingredients that cause a faster rate of burning may be incorporated into the composition, but noted that large loadings of such reactive ingredients may obviate the facilitating role of the flux. Beck et al. therefore recommended that the compositions omit such additional reactive ingredients.

There is therefore a continuing need for a delay composition that can be used reliably when confined in rigid metal confinement elements and yet may be used to produce long delays without unacceptably increasing the lengths of delay units.

DISCLOSURE OF THE INVENTION

An object of the present invention is to provide a delay composition that may be confined within a rigid delay element and yet still undergo reliable ignition and burning capable of producing long timing delays.

Another object of the invention is to provide a delay composition of the stated kind that can be produced easily and inexpensively.

Yet another object of the invention is to provide delay devices that are reliable in that they ignite and burn continuously with a high degree of reliability, even at low temperatures, and provide a reliable long delay period.

Another object of the invention is to provide delay elements and detonators or similar devices capable of providing long delay times while making use of rigid confinement elements for delay compositions.

According to one aspect of the present invention, there is provided a delay composition comprising mixed particles of silicon, barium sulfate and red lead, the red lead being present in an amount of about 3 to 15% by weight, preferably 6 to 12%, and more preferably 9 to 12% by weight, of the composition.

The barium sulfate and silicon components are preferably present in amounts of 40 to 65% by weight and 50 to 25% by weight, respectively, of the total weight of the composition.

The composition preferably also contains a binder causing collections of the particles to bind together in the form of free-flowing granules. The binder is preferably present in amounts of 0.2 to 0.6% by weight of the composition. Suitable binders include solvent-soluble polymers, silica and swelling clays, preferably water-soluble derivatives of cellulose, e.g. carboxymethyl cellulose.

According to another aspect of the invention, there is provided a delay element for a detonator or delay device, comprising an elongated hollow metal tube containing a delay composition comprising mixed particles of silicon, barium sulfate and red lead, the red lead being present in an amount of about 3 to 15% by weight of the composition. The tube is preferably open at both ends, and is preferably made of a rigid metal, most preferably zinc. The delay composition is preferably compressed to a density in the range of 1.8 to 2.2 g/cc, more preferably 1.95 to 2.15 g/cc.

The delay element preferably includes a sealer at one end thereof (the end subject to combustion first). This is may be a type of pyrotechnic composition that forms a slag of material which seals the open end of the delay element. This is desirable as the burn rate of the delay composition may be pressure-dependent and uniform delay times can be achieved when the sealer regulates the pressure within the delay element.

The delay element may also have a starter composition at the same end. The purpose of the starter composition is to generate enough heat to reliably initiate the slow burning delay composition having a high ignition temperature. A single composition may server both the function of a starter composition and of a sealer composition.

According to yet another aspect of the invention, there is provided a delay device, such as a detonator or inline delay device, comprising a detonation signal input, a charge to be detonated by the detonation signal input, and delay element separating said detonation signal input and said charge, the delay element being an element of the type described above.

BEST MODES FOR CARRYING OUT THE INVENTION

Figure 1:
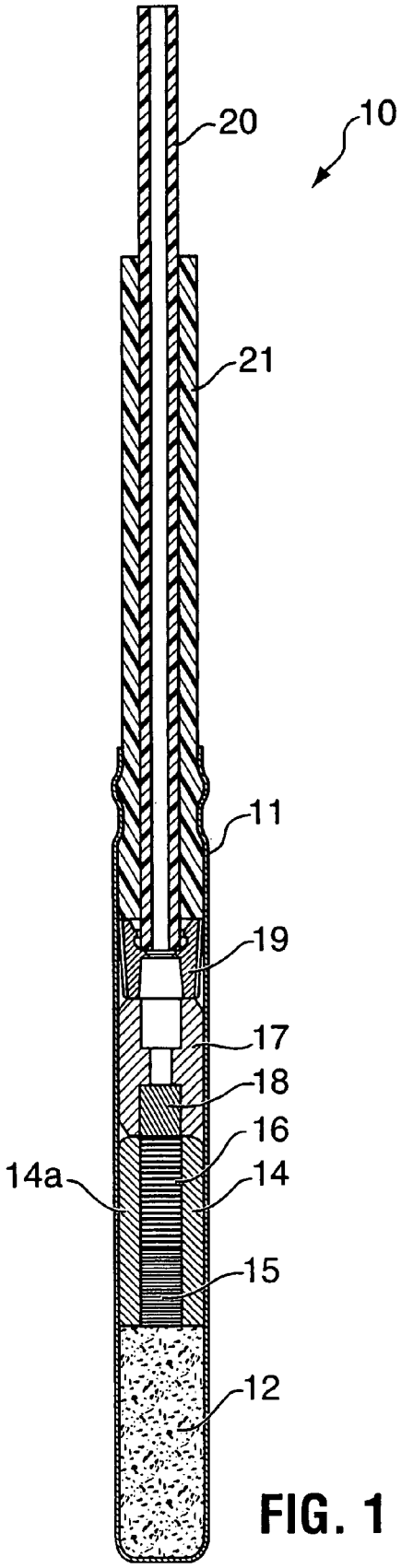
FIG. 1 is a vertical cross-section of an example of a non-electric detonator incorporating a delay element containing a delay composition of the present invention.

FIG. 1 of the accompanying drawings shows an example of a non-electric delay detonator 10 of a kind with a delay element and delay composition according to the present invention may be employed. As such, the detonator itself forms an example of one aspect of the present invention.

The detonator 10 has a metallic tubular detonator shell 11 closed at its bottom end and containing a base charge 12 of explosive (e.g. PETN) pressed or cast therein. Immediately above the base charge 12 is a confinement element 14 made of a rigid metal such as zinc, aluminum, steel or brass (preferably zinc). The confinement element 14 contains an initiating charge 15 (e.g. of lead azide) at the lower end of the element, and a delay composition 16 within the delay element above the initiating charge 15. The confinement element and its contents, particularly the delay composition, together form a delay element 14*a* that is fabricated prior to the assembly of the detonator. A starter element 17, which preferably also acts as a sealer, is located above the delay element. A lower end of a bore in the starter element contains a starter charge 18. An anti-static cup 19 is positioned above the starter element and is designed to receive a lower end of a shock tube 20, which carries the firing signal. A bushing 21 surrounds the lower end of the shock tube 20 where it enters the detonator 10, and the upper end of the detonator shell 11 is crimped to hold the bushing and shock tube in place.

Figure 2:
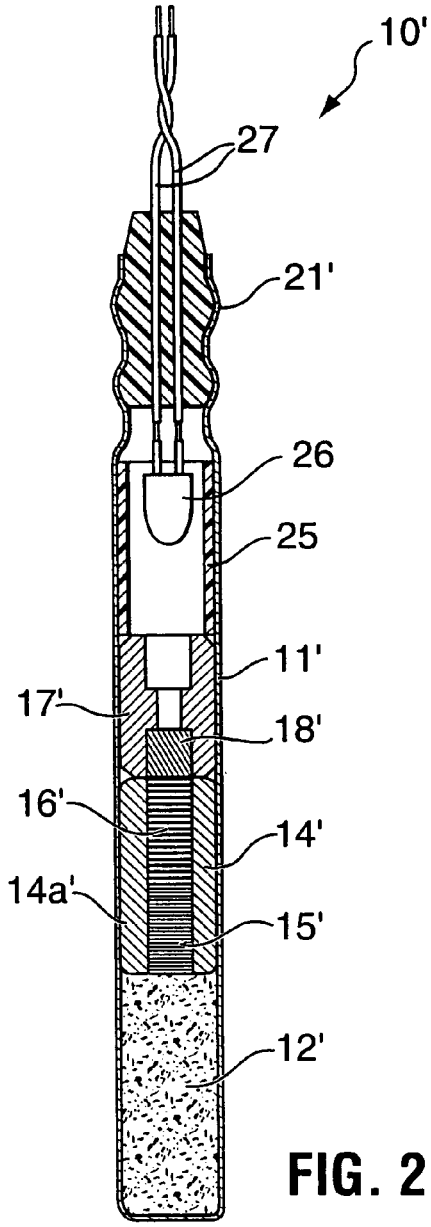
FIG. 2 is a vertical cross-section of an example of an electric detonator incorporating a delay element containing a delay composition of the present invention.

FIG. 2 shows an example of an electric detonator 10'. The detonator also has a metallic tubular detonator shell 11' closed at its bottom end and containing a base charge 12' of explosive (e.g. PETN) pressed or cast therein. Immediately above the base charge 12' is a delay element 14' made of a rigid metal such as zinc, aluminum, steel or brass (preferably zinc). The delay element 14' contains an initiating charge 15' (e.g. of lead azide) at the lower end of the element, and a delay composition 16' within the delay element above the initiating charge 15'. As in the previous embodiment, the confinement element 14' and its contents, particularly the delay composition, together form a delay element 14*a*' that is formed prior to the assembly of the detonator. A starter element 17', which may also act as a sealer, is located above the delay element, and a lower end of a bore in the starter element contains a starter charge 18'. A hollow plastic tube 25 is positioned above the starter element 17' and contains an electrically operated fuse head 26 attached to leg wires 27 that exit the detonator and that convey the electrical firing signal. A bushing 21' is positioned above the plastic tube 25 and has holes through with the leg wires may pass. The upper end of the detonator shell 11' is crimped around the bushing 21' to hold the leg wires and detonator contents securely in place.

As already noted, the delay compositions of the invention are particularly suitable for creating long delay periods, e.g. more than one second, preferably 1 to 12 seconds, more preferably 1 to 9 seconds, and most preferably 2 to 9 seconds. In order to produce delay elements, detonators, delay devices, and the like, of acceptable length (normally no longer than about 1.5 inches), this means that the compositions should preferably have a burn rate (burn duration) in the range of at least 1500 milliseconds per linear inch, more preferably 2,000 to 7000 milliseconds per linear inch, and most preferably about 4,000 to 6,000 milliseconds per linear inch, and ideally 5,000 to 6,000 milliseconds per linear inch. In contrast, in the experience of the inventor of the present invention, the burn rates of those compositions of U.S. Pat. No. 4,419,154 that contain red lead fall in the range of about 300 to 1500 milliseconds per linear inch when they contain similar amounts of silicon of similar particle size to those of the present invention.

As noted above, the delay compositions of the present invention contain about 3 to 15% by weight of particulate red lead in addition to particles of silicon and barium sulfate. More preferably, the amount of red lead is 6 to 12% by weight, and most preferably it is 9 to 12% by weight. If the percentage of red lead is increased much beyond about 15% by weight, the burn rate becomes excessively fast for long delays, whereas if the percentage is less than 3%, there are no benefits in terms of robustness of combustion and reliability. Although the amount of red lead is much less than previously employed in compositions of this kind (e.g. as disclosed in U.S. Pat. No. 4,419,154), it has been surprisingly found that the amount is sufficient to impart suitable robustness and reliability of combustion to the composition when used in rigid metal confinement elements, without increasing the burn rate unacceptably for long delay uses.

The red lead used in the compositions of the present invention does not act as a flux. Without wishing to be bound by any particular theory of operation, the red lead appears to react with silicon at a low ignition temperature (about 500° C.) and generates heat which facilitates the barium sulfate/silicon combustion reaction whose ignition temperature is high (about 1200° C.).

In the compositions of the invention, the relative proportions of the silicon and barium sulfate are preferably 40 to 65% by weight barium sulfate and 25 to 50% by weight silicon (this corresponds to 45 to 70% by weight of barium sulfate to 30 to 55% by weight of silicon before the addition of the red lead). Preferably, except possibly for a binder (described below), no other materials are present in the composition. While the presence of fluxes can be tolerated, there is no particular advantage to their use in the present invention and their use merely adds cost.

The compositions of the present invention may be prepared simply by dry mixing particles of the essential ingredients in the indicated proportions. In the case of the barium sulfate, the particulate starting material preferably has a specific surface area of typically about 0.8 $m^2/g$ (e.g. about 0.75 to 0.85 $m^2/g$). The silicon powder preferably has a specific surface area of about 6 to 8 $m^2/g$. The red lead preferably has a particle size of about 1 to 3 microns.

Although dry mixing of the ingredients is possible, wet mixing is preferred in order to achieve greater homogeneity and because wet mixing allows for the addition of a binder whose function is to agglomerate collections of individual particles into larger free-flowing granules. Suitable binders include solvent-soluble polymers, fine silica and finely ground swelling clays. While polyvinylchloride may be used as a binder, it is more preferable to use a water-soluble form of cellulose, e.g. nitrocellulose or, most preferably, sodium carboxymethyl cellulose (e.g. as manufactured by a European subsidiary of Hoechst and sold under the trademarks TYLOSE and TYLOSE C-600). This material is a sugar-like powder that is dissolved in water and then used for the wet mixing step. Standard methods of wet mixing, granulation and drying may be employed. As noted, the presence of a binder makes it possible to produce the composition in the form of free-flowing granules made up of collections of particles of silicon, barium sulfate, red lead and binder. Free-flowing granules have the ability to flow freely (i.e. without clumping in the nature of dry sand) when poured from one container to another. This ability is highly preferred given that the composition must be introduced into the interior of a rigid confinement element of narrow interior diameter (e.g. typically about 3.35 mm) and then compacted. It is also an advantage that the agglomerated granules each tend to contain particles (of all of the main constituents) with a range of particle sizes. The homogeneity of the resulting composition is therefore very high and there tends to be little separation of large and small particles when the composition is subjected to storage or use over a long period of time. The binder, when present, is preferably contained in the resulting composition (when dry) in an amount in the range of 0.2 to 0.6% by weight, more preferably 0.3 to 0.5% by weight, of the total composition. With amounts more than 0.6% by weight, the granulation process becomes difficult. When the amount is less than about 0.2% by weight, the binding effect may become inadequate.

After formation and drying, the composition is introduced into a rigid metal confinement element, as noted, and is compacted therein, usually by introducing a metal rod into one end of the confinement element and pressing while preventing the composition from escaping from the opposite end of the tubular confinement element. Pressing from both ends may, of course, also take place. The resulting composition in the confinement element preferably has a density falling within the range of 1.90 to 2.20 g/cc, most preferably 1.95 to 2.15 g/cc. Compaction to a suitable density is important to ensure reliable propagation of combustion, although the desired density may vary somewhat from composition to composition.

The presence of red lead in the delay composition in the indicated amounts does not alter the essential character of the Si/$BaSO_4$ mixture as a slow delay composition (i.e. it does not substantially speed up or slow down the burning rate) but its presence does impart to the composition resistance to quenching caused by the heat-sink effect of the tubular metal confinement element, so that the composition is effective in rigid elements such as zinc elements.

Rigid elements containing the compositions of the invention have shown themselves in tests to be effective as reliable, reproducible delay elements within the confines of standard detonator shell dimensions used in the art while providing delays of more than one second, e.g. from about 2 seconds to optimally 9 seconds or even higher. The rigid elements tested were in fact zinc elements, being the presently preferred metal for rigid confinement elements, but may of course have been made of another suitable material, e.g. aluminum, steel or brass.

In the most preferred forms, the delay compositions of the invention consists only of silicon, barium sulfate, red lead and optionally a binder in the indicated amounts, i.e. there are no other materials such as oxidants and fluxes, except for incidental or adventitious minor impurities or ingredients.

The invention will now be further described by way of the following Examples which are illustrative of delay compositions according to the invention, and of detonators and delay devices, also according to the invention. The Examples should not be taken as limiting the broad scope of the invention as defined by the accompanying claims.

EXAMPLE 1

Small quantities (10 g samples) of dry mixed $BaSO_4$/Silicon compositions were prepared containing 3%, 5%, 7%, and 9% by weight of $Pb_3O_4$.

Rigid zinc tubular confinement elements having bore diameters of 3.35 mm were loaded with each of the compositions, as well as a control containing no $Pb_3O_4$. The loaded rigid confinement elements were assembled into detonators for testing. It was found necessary to use a $Pb_3O_4$/Si starter composition on top of the $BaSO_4$/Silicon/$Pb_3O_4$ mixture for reliable ignition. A pyrotechnic sealer element was placed on top of the starter element. These detonators were assembled as shocktube (non-electric) detonators and tested for average delay timing and coefficient of variation (CV). The results of the tests are shown in Table 1 below. The 5% and the 7% $Pb_3O_4$ samples showed a noticeable improvement in timing accuracy compared to the control containing no $Pb_3O_4$.

TABLE 1

| $Pb_3O_4$ CONTENT | AVERAGE DELAY TIMING | COEFFICIENT OF VARIATION |
|---|---|---|
| 0 | 2687 ms | 2.1% |
| 3 | 2800 ms | 1.6% |
| 5 | 2756 ms | 0.9% |
| 7 | 2737 ms | 0.8% |
| 9 | 2716 ms | 1.4% |

The robustness of propagation of the composition was measured by testing composition ignition at −40° C. Rigid confinement elements of the above kind were prepared containing $BaSO_4$/Silicon and 6% $Pb_3O_4$. As before, these elements were assembled into non-electric detonators. Testing of the detonators after exposure to a temperature of −40° C. for 48 hours showed reliable functioning with timing accuracy as good as a control sample tested at room temperature, while 4/5 detonators made with $BaSO_4$/Silicon failed to propagate through the delay column. During the course of ambient temperature testing of rigid elements containing $BaSO_4$/Silicon and no $Pb_3O_4$, a number of failures (2/5) were recorded where the $BaSO_4$/Silicon column failed to propagate. These failures serve to show that the addition of a small amount of $Pb_3O_4$ does indeed impart a significant improvement to this composition without substantially increasing the combustion propagation rate.

It has thus been demonstrated that the addition of a small amount of $Pb_3O_4$ to a $BaSO_4$/Silicon pyrotechnic mixture results in a new improved composition which show improved performance in rigid elements.

EXAMPLE 2

Dry Mix:

A production mix sample of standard barium sulfate/silicon composition containing 45% by weight of silicon and 55% by weight of barium sulfate (referred to as Y composition) was first divided in 5 small mixes of 10 g each in a small Velostat™ (electrically conductive polymer) container. The first sample was left intact as a reference control sample while an addition of 3%, 5%, 7%, and 9% of red lead was made in the subsequent mixes. Conductive rubber balls were added to the mixes to help the ingredients to mix together during tumbling of the Velostat™ containers.

Wet Mix:

A 1 Kg batch of a modified standard barium sulfate/silicon composition (Y composition) having 6% red lead in it was prepared. The respective mass ratios for the ingredients were 51.7% of $BaSO_4$ (0.8 $m^2$/g surface area), 42.3% Silicon (milled for 12 hours) and 6% of $Pb_3O_4$. Although the red lead was added to the medium from the start to ensure a good dispersion of particles, a regular wet mixing process for standard barium sulfate/silicon composition was followed.

Tests:

The compositions (both of the dry mix and the wet mix) were tested for ignition by friction. None of the compositions containing red lead showed signs of ignition when tested for friction sensitivity using a 1.33 kg steel torpedo sliding with 30° angle from 30 inch height.

The differential thermal analysis (DTA) of a composition containing no red lead and a composition containing 5% red lead showed that the presence of red lead in the standard barium sulfate/silicon composition reduced the ignition point of the composition, which facilitated ignition of the powder.

Methodology of Powder Loading in Zinc Element

A zinc confinement element was weighed, placed in a holder and a delay composition of the invention was poured into its cavity and pressed at the desired pressure in many small increments until full. The element was weighed again and the powder content recorded. The reliability (standard deviation SD) of powder content in elements was found good for both element lengths evaluated, as shown in Table 2 below.

TABLE 2

| Element Length | Charge Weight | Sample Size | SD |
|---|---|---|---|
| 12 mm | 201 mg | 30 | 2.1 |
| 30 mm | 504 mg | 30 | 6.0 |

Delay Timing "vs" Red Lead Content in Barium Sulfate/Silicon Compositions.

Figure 3:
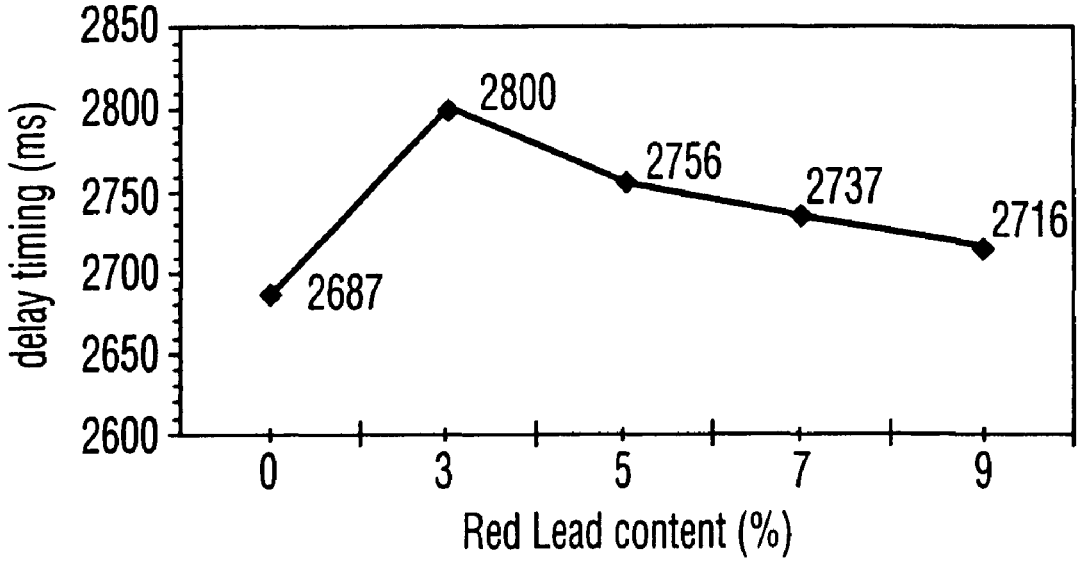
FIGS. 3 to 20 are graphs showing results obtained in the ways described in the following Examples.

The graph of FIG. 3 shows that the presence of red lead in a standard composition of barium sulfate/silicon (55%:45% by weight) has first, an effect of slowing down the burn rate with the 3% addition of red lead and slight speed increases with the higher red lead content.

The delay timings were determined in ORICA® 2.9 inch detonator shell having a 9.3 mm (0.362") zinc confinement element as main and a regular starter and sealer from drawn lead tube.

Deviation in Delay Times "vs" Red Lead Content in Barium Sulfate/Silicon Compositions.

Figure 4:
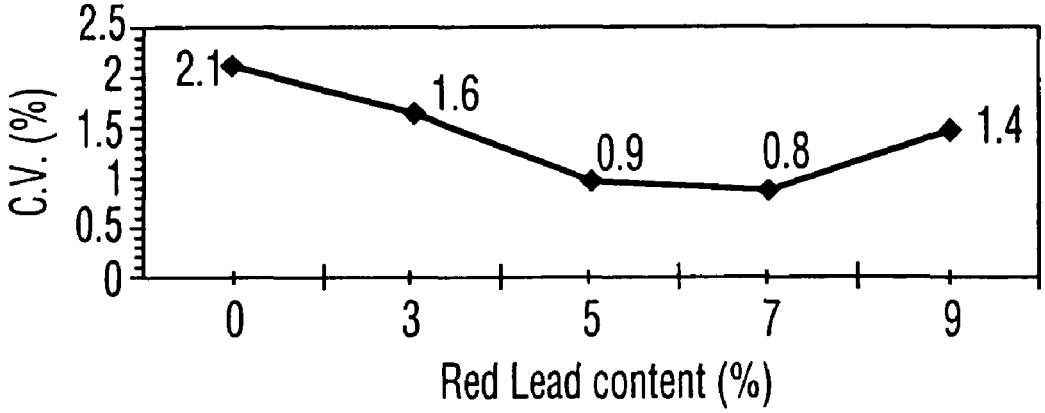

From previous timing results, the graph of FIG. 4 illustrates the coefficient of variation of measured timing delays.

It can be seen that any barium sulfate/silicon mix that had the presence of red lead in it produced a better timing accuracy than the control sample containing no red lead.

The sample size for the above results was only 5 detonators per mix, so, in order to confirm the validity of the delay timing obtained, the mix with 5% Red Lead was further loaded in 30 zinc confinement elements and in two different element lengths. They were tested for timing accuracy in ORICA® detonator shells and results compared with those obtained by others for this specific lot of the standard barium sulfate/Si composition. The results are shown in Table 3 below (in which SD stands for standard deviation).

TABLE 3

| Zinc element length | Average timing | SD | CV | sample size |
|---|---|---|---|---|
| 12 mm | 3487 ms | 54 | 1.5 | 30 |
| 30 mm | 8383 ms | 91 | 1.1 | 30 |

In lead elements, the following provided the following timing results for this lot of the standard composition:

| | |
|---|---|
| 1896 ms average with a SD of 71; | CV = 3.7% cutting length at 0.305 inch (7.7 mm) |
| 9921 ms average with a SD of 150; | CV = 1.5% cutting length at 1.318 inch (33.4 mm) |

Powder Loading Pressure Effect on Detonator Delay Timing

Figure 5:
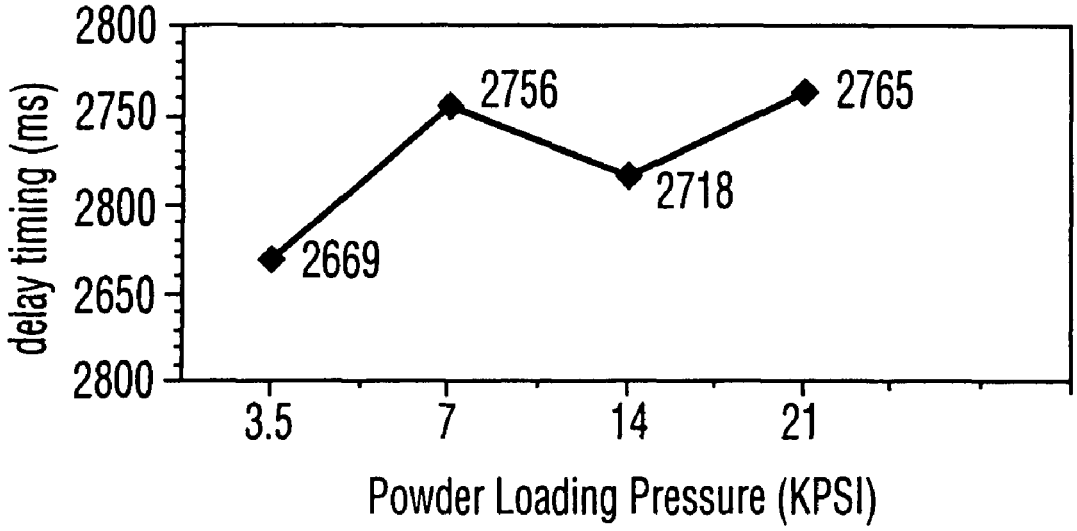
Figure 6:
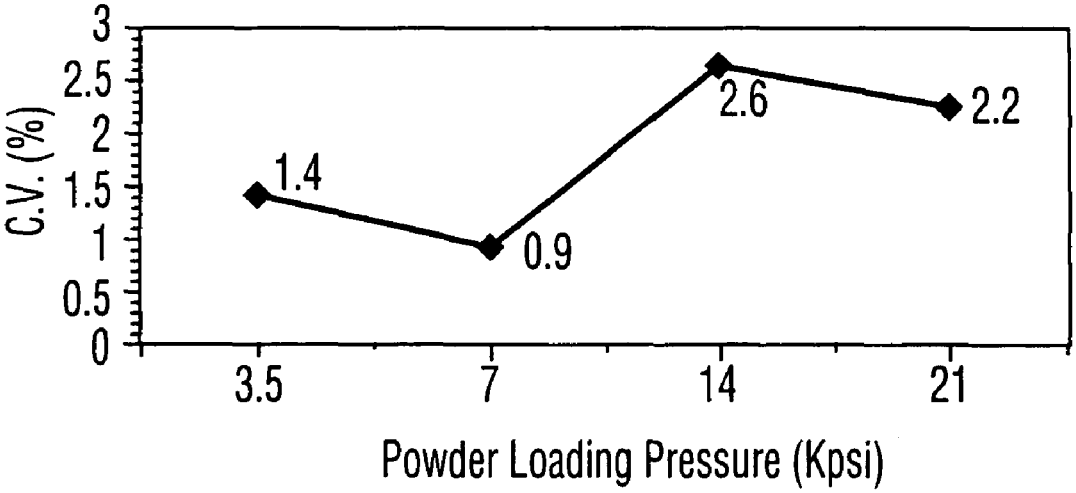

In order to define the proper range for powder loading in rigid zinc confinement elements, the 5% red lead content mix was loaded in the 9.30 mm zinc confinement elements, pressed at different pressure and fired. Although all detonators made with elements loaded at 28 Kpsi failed to ignite, the results illustrated in the graphs of FIGS. 5 and 6 indicated that powder loading pressure in the range between 3.5 Kpsi to 21 Kpsi have a very little effect on the overall timing results. A better timing accuracy is observed for those elements loaded at 3.5 Kpsi and 7 Kpsi.

Powder Density "vs" Loading Pressure

Figure 7:
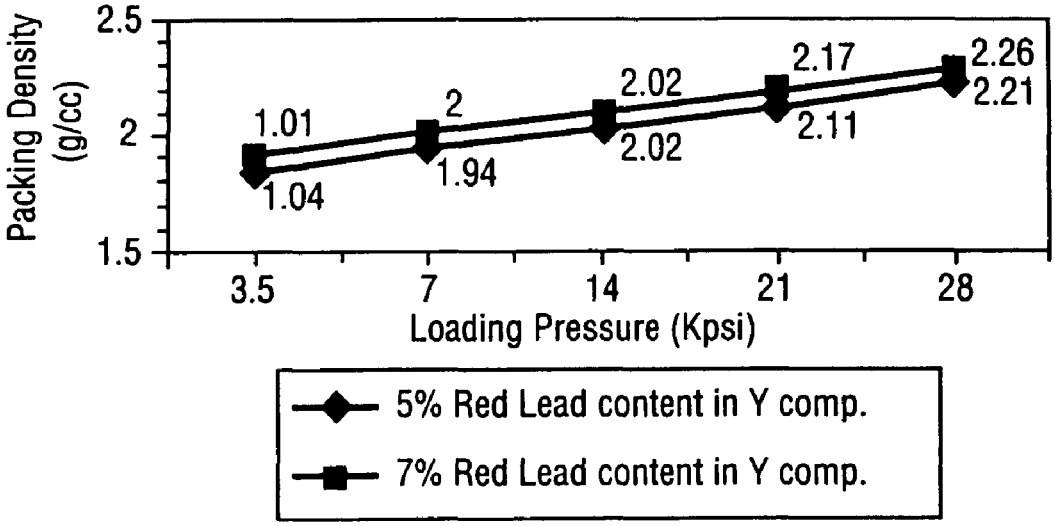

The density of the delay composition loaded in zinc confinement elements and at different pressure was measured for both 5% and 7% red lead mixes that showed the best timing performances. The results are shown in the graph of FIG. 7. According to the previous results, it is recommended that the powder loading density shall be kept between 1.80 g/cc and 2.20 g/cc and more preferably at 1.95 to 2.15 g/cc.

Robustness of Propagation

An evaluation was made to measure the timing shift between +20° C. and −40° C. on various detonator designs in order to demonstrate the advantage of adding some red lead in barium sulfate/Si composition with either the drawn lead or rigid zinc confinement element technology. The results are shown in the graph of FIG. 8.

Note: All main elements (lead or zinc) were prepared to be in the same order of delay timing, between 2800 ms and 3000 ms.

Figure 8:
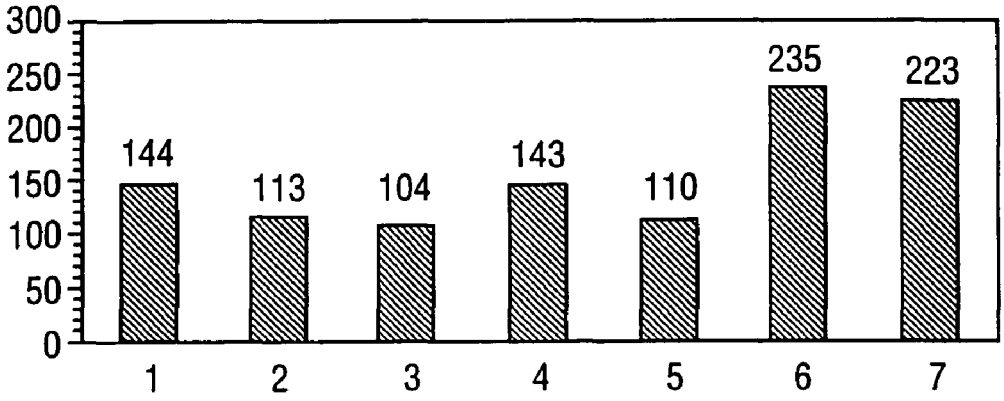

In the graph of FIG. 8:

Column 1=Timing shift on barium sulfate/Si composition control sample in regular drawn lead & ORICA® detonator.

Column 2=Timing shift on barium sulfate/Si composition+4% Red Lead in regular drawn lead & ORICA® detonator.

Column 3=Timing shift on barium sulfate/Si composition+6% Red Lead in regular drawn lead & ORICA® detonator.

Column 4=Timing shift on barium sulfate/Si composition+4% Red Lead in zinc main element. Regular starter (red lead+silicon 75:25) and sealer with a small bore element with a composition of red lead and silicon (63:37) from drawn lead in ORICA® detonator shell.

Column 5=Timing shift on barium sulfate/Si composition+6% Red Lead in zinc main element. Regular starter and sealer as above from drawn lead in ORICA® detonator shell.

Column 6=Timing shift on barium sulfate/Si composition+6% Red Lead in zinc main element. 150 mg of red lead+silicon (75:25) and 100 mg of G comp. loaded in the aluminum type 2 sealer in DNES® detonator shell.

Column 7=Timing shift on barium sulfate/Si composition+6% Red Lead in zinc main element. 150 mg of red lead+silicon (75:25) loaded at first in the main element and 215 mg of G comp. in aluminum type 2 sealer in DNES® detonator shell.

Although the ORICA® detonator design showed a better timing stability, no failure to ignite was observed on more than 100 detonators fired at −40° C. and having a main element made of zinc.

EXAMPLE 3

In this Example, the maximum quantity of red lead that can be added to the barium sulfate/Si composition for a long delay period detonator is identified and the resistance to shock stop (failure of a detonator due to the shock from an adjacent explosion) of such systems is characterized for both, drawn lead and rigid confinement element technology.

All mixes used for the delay timing evaluation are from small dry mixes where red lead was added in various quantities in barium sulfate/Si. The ingredients were put together and tumbled in small Velostat pots with conductive rubber balls.

The mixes used for the shock resistance evaluation were made wet mix in batch of 700 g.

Powder Sensitivity:

Friction sensitivity

Test Description:

A steel torpedo of 1.33 Kg weight slides on a sample of powder from 30 inch height and 30° angle.

No ignition observed in ten trials when the 12% red lead content mix was tested for friction sensitivity.

Other powder samples containing less than 9% of red lead were also tested for friction sensitivity and did not show any signs of ignition either.

Detonator Construction:

In order to avoid sympathetic detonations during shock stop testing, the lead azide charge (110 mg) was pressed inside the zinc element cavity. The rest of the cavity was filled with the delay powder. A regular starter (red lead+silicon 75:25 by weight) and sealer (sealer with a small bore element filled with red lead+silicon 63:37 by weight) was pressed on top of the rigid element and a sealer crimp applied.

A low entropy plastic disc (LE disc) was put on top of the lead azide charge for those detonators made with the main delay elements from a drawn lead rod.

Test Results:

Delay Timing

Figure 9:
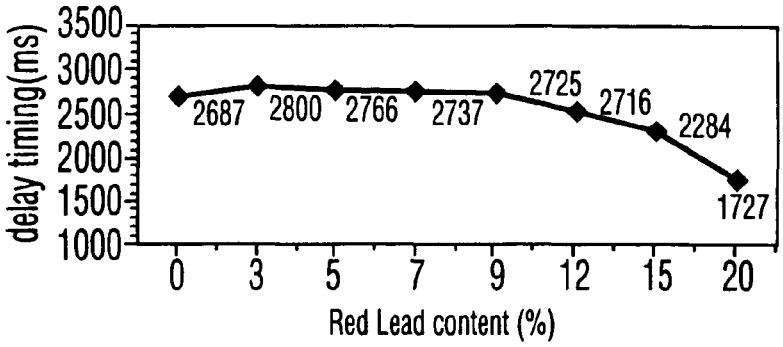
Figure 10:
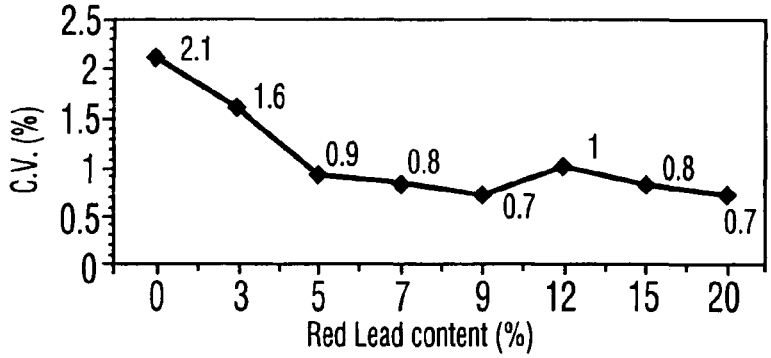

The graphs of FIGS. 9 and 10 show the delay timing pattern for modified basic barium sulfate/silicon composition with 0% to 20% red lead content. A plateau of relatively stable delay times is observed for those mixes having between 0% and 12% of red lead added in the basic barium sulfate/silicon composition. FIG. 9 is a graph showing the delay timing in zinc elements (9.30 mm L) on Y comp+Red Lead content (E starter & H sealer from drawn lead). FIG. 10 is a graph showing the CV's from delay timing in zinc elements (9.30 mm) on Y comp.+Red Lead content (E starter & H sealer from drawn lead)

Shock Stop—Test Results

A drum test was performed on composition Y and modified comp. Y containing 6% and 12% of Red Lead. The LP detonators from DNES (7000 ms) were also tested for shock resistance.

| | | |
|---|---|---|
| Test method used: | Cooking mode; meaning that both detonators were fired simultaneously. | |
| Delay timings: | target: | 5000 ms and 7000 ms |
| | donor: | 2500 ms and 3500 ms |

The shock pressure test was performed at 14000 psi (Position #11 in template).

Test 1 Main delay composition in rigid zinc elements

| | |
|---|---|
| Control sample of Y comp.: | 3/10 failures caused by shock stop. |
| Y + 6% of Red Lead: | 6/10 failures caused by shock stop. |
| Y + 12% of Red Lead: | 0/10 failure. |
| DNES 7000 ms: | 0/10 failure. |

Test 2 Main delay composition in drawn lead elements

| | |
|---|---|
| Control sample of Y comp.: | 5/10 failures caused by shock stop; 1 failed at the LE disc. |
| Y + 6% of Red Lead: | 8/10 failures caused by shock stop. |
| Y + 12% of Red Lead: | 6/10 failures caused by shock stop. |

EXAMPLE 4

This Example relates to the use of a binder (carboxymethyl cellulose) in the preparation of the delay compositions of the invention.

Batches (500 g each) of delay compositions were made from barium sulfate (Type N, having a specific surface area of 0.8 $m^2/g$), silicon (2.6 microns in size, from SKW powder company, ground for 12 hours), red lead and sodium carboxymethyl cellulose (TYLOSE® C-600) using a Waring blender. The batches were formed by dissolving a powder of the carboxymethyl cellulose in 200 ml water in a mixing vessel over two minutes for complete dissolution, adding the red lead and mixing for about one minute, adding half of the quantity of barium sulfate and silicon and mixing for two minutes, then adding the remainder of the silicon and barium sulfate and mixing for a further 2 minutes. The ratio of water to dry ingredients was 40%. The batches contained 6%, 9% or 12% red lead and amounts of TYLOSE from 0.3 to 0.6% by weight. The ratio of barium sulfate to silicon (discounting other ingredients) was about 55:45 by weight). The mixtures were then dried for a few hours and manually granulated behind a shield through a 20 Tyler mesh sieve. The resulting granules were found to flow very well (i.e. freely), e.g. when poured from one container to another.

The granulated mixtures were loaded into rigid zinc confinement elements by placing the zinc elements in a holder and scooping the composition and pouring it into the element cavity and pressing at the required pressure for proper density. This was done in increments until the element was full. In all cases, the incremental loading was 5.0 mm (pressed). This corresponded to a volume of 90 mg powder for each increment. A subsequent test with incremental loading of 3.0 mm (50 mg of powder) produced an even better coefficient of variation (CV) for delay timing indicating that the procedure benefits by having many small loading increments for better reliability. It is to be noted that the loading pressure has to be reduced in order to keep the same powder loading density with smaller increments. The results are shown in Table 4 below.

TABLE 4

| | Test # 1 | Test # 2 |
|---|---|---|
| Composition | $BaSO_4/Si/Pb_3O_4$/Tylose | $BaSO_4/Si/Pb_3O_4$/Tylose |
| Incremental loading | 5.0 mm pressed | 3.0 mm pressed |

TABLE 4-continued

| | Test # 1 | Test # 2 |
|---|---|---|
| Loading force | 150 pounds on punch (12000 psi) | 100 pounds on punch (8000 psi) |
| Pressed density | 2.10 g/cc | 2.10 g/cc |
| Average delay of timing | 7369 ms | 7399 ms |
| Coefficient of variation | 2.2% | 1.8% |

Detonator Construction

Detonators were constructed with the rigid zinc confinement elements. These detonators contained a starter comprising a mixture of red lead and fine silicon (so-called E starter) and a sealer (so-called H sealer) prepared with a small bore element made from drawn lead rod containing a mixture of red lead and very fine silicon. All the results were obtained using ORICA® detonator shells.

Formulation Study

Wet mixes with 6%, 9% and 12% red lead and 0.5% TYLOSE® in Composition Y were made and assessed in 30 mm zinc elements for detonator timing.

The 6% red lead mix showed 20% detonator failures at room temperature. The 9% red lead mix did not show detonator failure at room temperature, but 50% detonators failed when fired at low temperature (−40° C.). The 12% red lead mix showed no failures at −40° C. and was selected for the following extended characterization.

Delay Time vs. Length of Element

Figure 11:
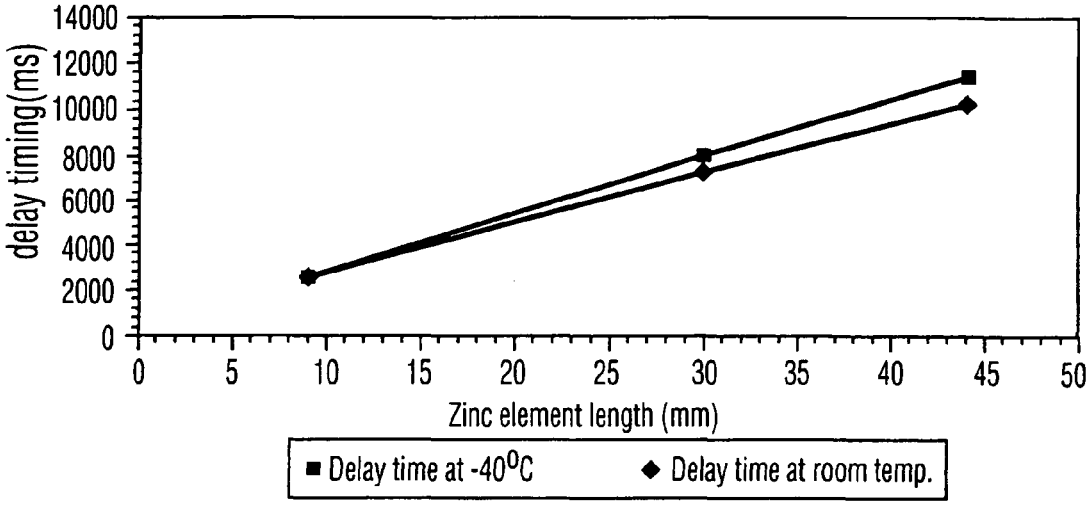

The burn rate of the composition in zinc elements was found to be very linear, even at low temperatures (−40° C.). The graph of FIG. 11 shows the delay time pattern for the long period (LP) composition $BaSO_4/Si/Pb_3O_4$/TYLOSE (48/39.5/12/0.5% by weight) versus the element length.

Delay Time vs. Loading Pressure

Figure 12:
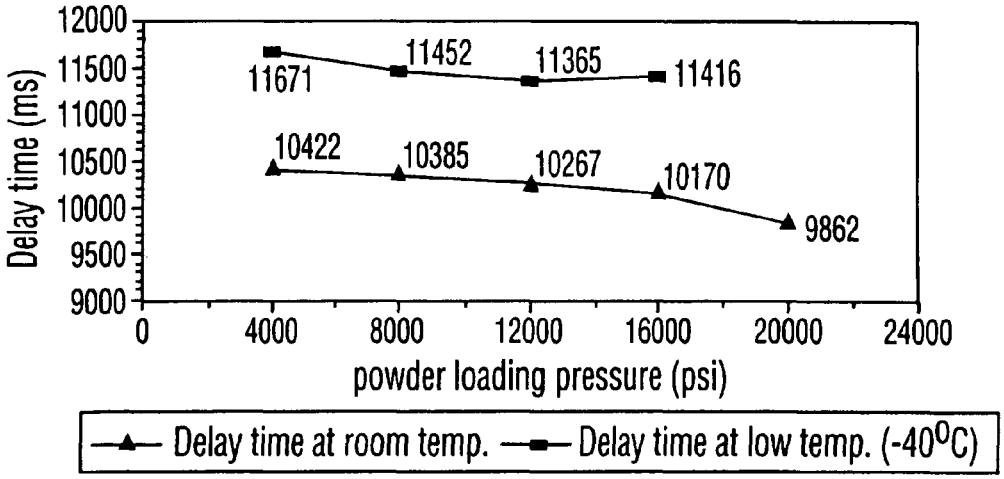

The graph of FIG. 12 shows the delay time pattern for $BaSO_4/Si/Pb_3O_4$/TYLOSE (48/39.5/12/0.5% by weight) in 44 mm length elements.

Delay Time vs. Tylose Content

Figure 13:
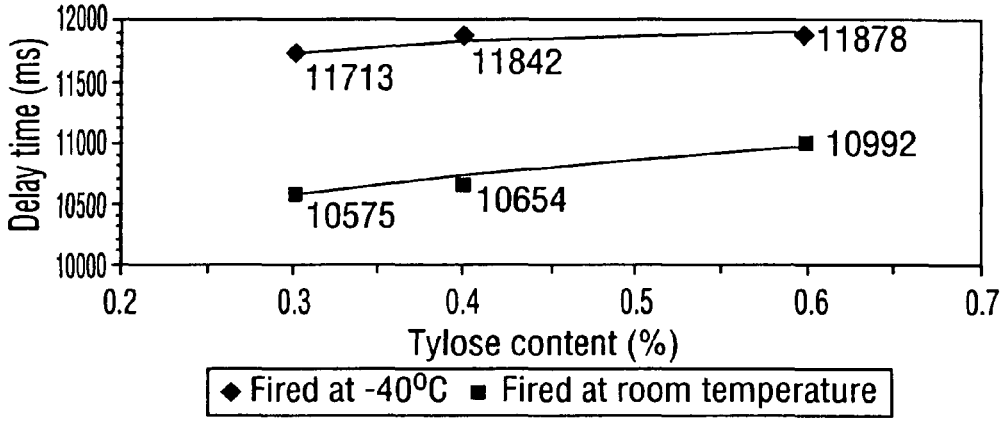

The graph of FIG. 13 shows that the addition of Tylose slows down the composition burn rate. The loading pressure was kept constant at 12000 psi in 44 mm zinc elements.

Testing at Low Temperature

Figure 14:
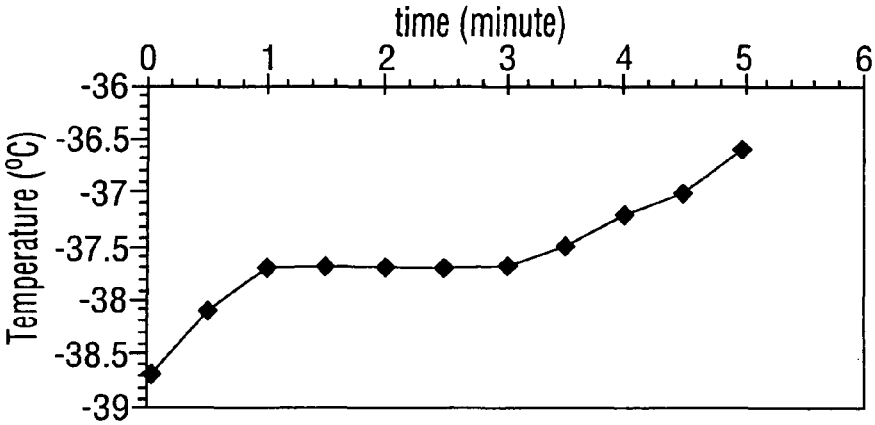

A stress test was widely used in this evaluation in which the detonator was frozen in ice for 16 to 24 hours and fired within one minute. In order to give confidence to this test FIG. 14 shows the "warming up" curve for a sample taken out of the freezer for five minutes.

Robustness of Propagation

The powder loading density is an important factor for the composition. This was found to be particularly true when detonators were fired at low temperature.

Figure 15:
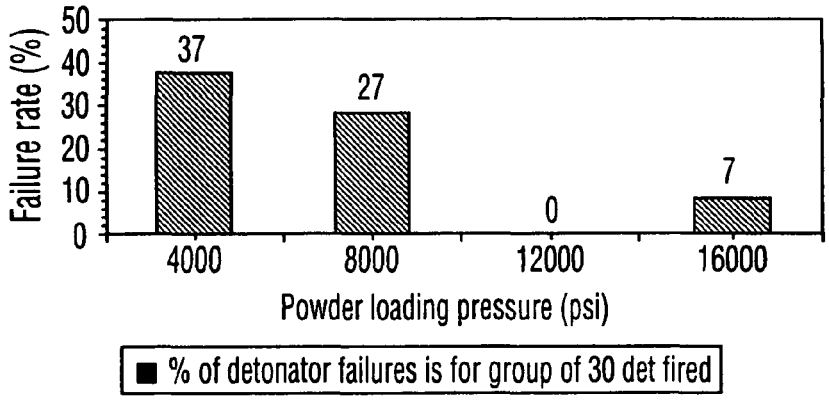

The graph of FIG. 15 shows the failure rate versus powder loading pressure (psi) for $BaSO_4/Si/Pb_3O_4$/TYLOSE (48/39.5/12/0.5% by weight) loaded in 44 mm zinc elements fired at −40° C.

Figure 16:
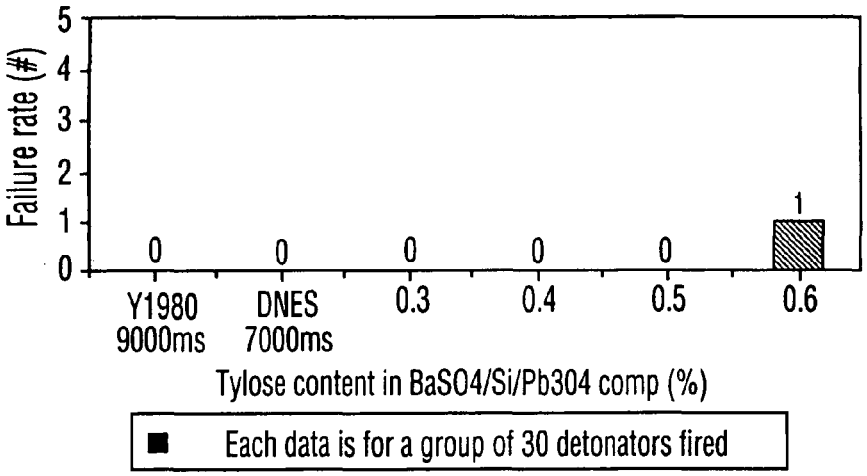

The graph of FIG. 16 shows the number of detonator failures recorded when fired at −40° C. TYLOSE contents of 0.3, 0.4 and 0.5% by weight did not cause failures.

Timing Shift

Figure 17:
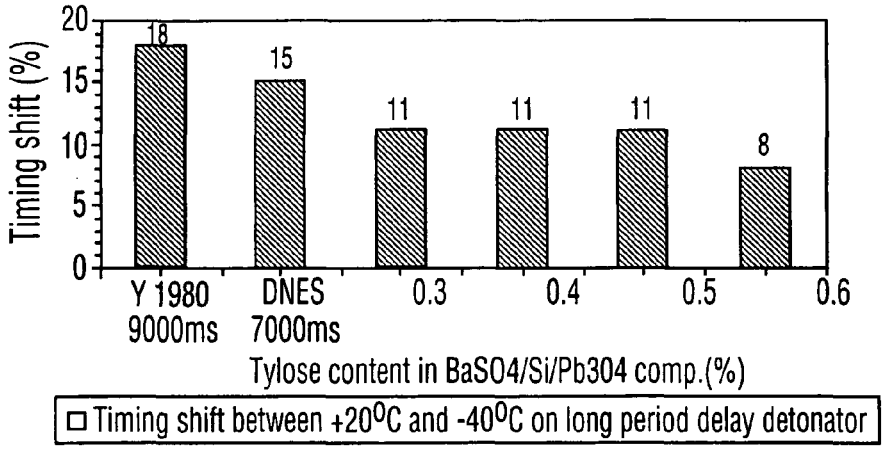

The graph of FIG. 17 shows the timing shift between +20° C. and −40° C. for long period composition $BaSO_4/Si/Pb_3O_4$/TYLOSE in 44 mm zinc confinement elements and for regular ORICA® and DNES® long period detonators.

long period detonators.

Figure 18:
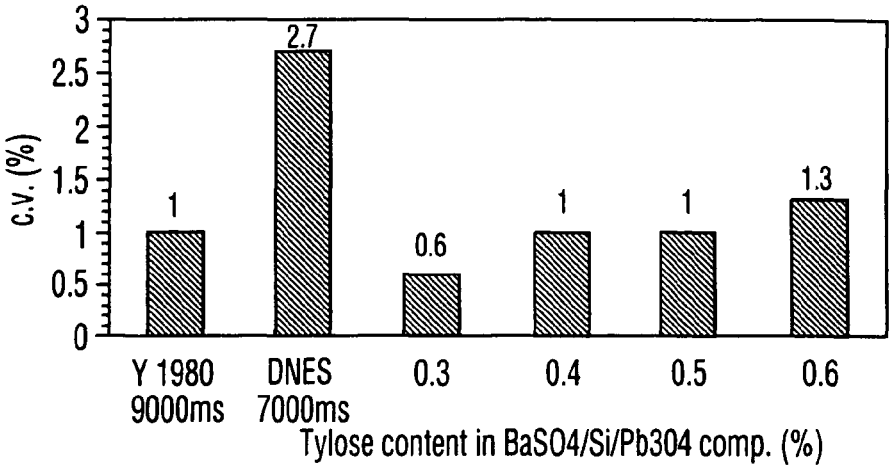

The graph of FIG. 18 shows the coefficient of variation on delay timing at −40° C. for the $BaSO_4/Si/Pb_3O_4$/TYLOSE composition pressed at 12,000 psi in 44 mm zinc element, and for regular ORICA® and DNES® long period detonators.

Pressed Density

Figure 19:
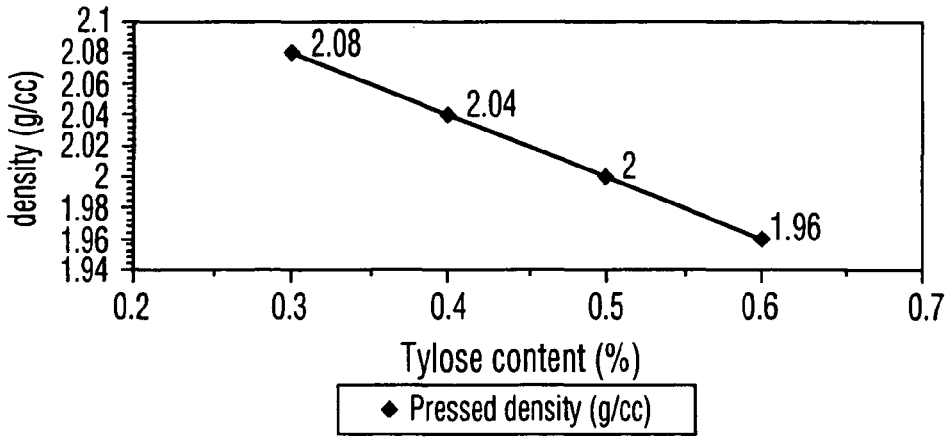

The pressed density of composition $BaSO_4/Si/Pb_3O_4$ in 44 mm length zinc elements versus TYLOSE C-600 content is shown in FIG. 19. The loading pressure was kept fixed at 12000 psi.

Figure 20:
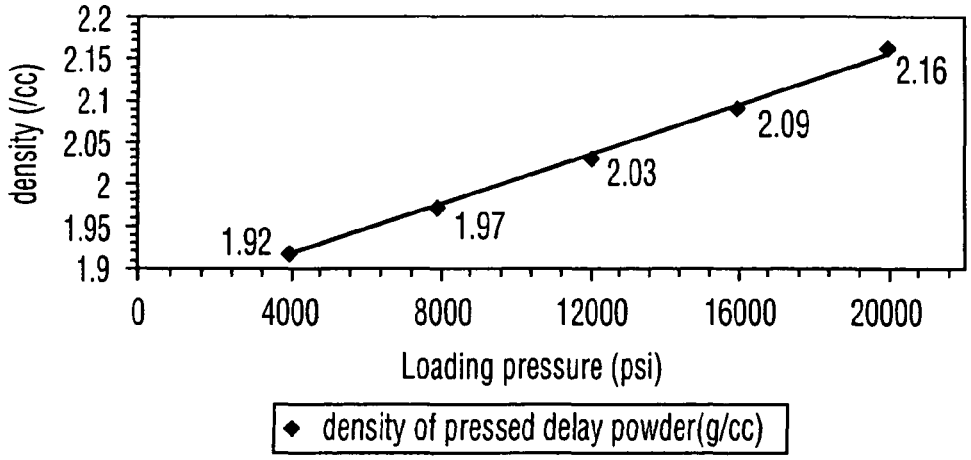

The pressed density of composition $BaSO_4/Si/Pb_3O_4$/Tylose in zinc elements of 44 mm length is shown in FIG. 20. Here the TYLOSE content was kept fixed at 0.5% by weight.

Resistance to Shock Stop

A drum test was performed on the following detonator samples:

ORICA® LP 19

DNES® 7000 ms

Composition containing red lead+0.5% TYLOSE in 30 mm length zinc elements.

The donor detonator was an ORICA® LP 10 (3500 ms delay) for all tests.

The shock pressure test was performed in "cooking mode" meaning that both detonators, the donor and the target, were fired simultaneously. The results are shown in Table 5 below:

TABLE 5

| Detonator sample | 12000 psi | 14000 psi |
|---|---|---|
| ORICA LP 19 | 5/10 failures | not tested |
| DNES 7000 ms | 0/15 failure | 0/15 failure |
| New LP in zinc | 0/15 failure | 2/15 failures |

The above results show that at least a preferred composition made of barium sulfate/silicon/red lead (12 hours ground)/TYLOSE® C-600 with respective mass ratios of 48/39.7/12/0.3% loaded into rigid zinc elements at a density of 2.08 g/cc±0.05 g/cc was found to have equal, if not superior, detonator performance compared to regular long delay detonators using lead confinement elements.

The invention claimed is:

1. A delay element for a detonator or delay device, which provides a burning delay of at least two seconds, the delay element comprising:

an elongated hollow tube made of a rigid metal, and a delay composition contained in the elongated hollow tube and comprising mixed particles of silicon, barium sulfate and red lead, the red lead being present in the delay composition in an amount of about 3 to 15% by weight of the composition, the silicon having a specific surface area of about 6 to 8 $m^2/g$.

2. The delay element of claim 1 wherein the delay composition has a density in the range of 1.8 to 2.2 g/cc.

3. The delay element of claim 1 wherein the delay composition has a density of 1.95 to 2.15 g/cc.

4. The delay element of claim 1 wherein the tube is made of a metal selected from the group consisting of zinc, aluminum, steel and brass.

5. The delay element of claim 1 wherein the tube is made of zinc.

6. The delay element of claim 1 wherein the delay composition further contains a binder causing collections of said particles to agglomerate together in the form of granules.

7. The delay element of claim 6 wherein said binder is selected from the group consisting of solvent-soluble polymers, silica and swelling clays.

8. The delay element of claim 6 wherein said binder is a water-soluble derivative of cellulose.

9. The delay element of claim 6 wherein the binder is carboxymethyl cellulose.

10. The delay element of claim 9 wherein said binder is present in an amount of 0.2 to 0.6% by weight of the composition.

11. The delay element of claim 1 wherein the particles of barium sulfate have a specific surface area of about $0.8m^2/g$, and the red lead has a particle size of about 1 to 3 microns.

12. The delay element of claim 1 having a length corresponding to a burning delay of about 2 to 9 seconds.

13. A delay element for a detonator or delay device, which provides a burning delay of at least two seconds, the delay element comprising:

an elongated hollow tube made of a rigid metal selected from the group consisting of zinc, aluminum, steel and brass, a delay composition contained in the elongated hollow tube, the delay composition being in the form of free flowing granules, each consisting essentially of mixed particles of silicon, barium sulfate and red lead together with a binder, the red lead being present in an amount of about 3 to 15% by weight of the composition, the silicon having a specific surface area of about 6 to 8 $m^2/g$, and the delay element having a length corresponding to the burning delay of at least two seconds.

14. A detonation delay device comprising a combustion starter, a charge to be detonated, and a delay element separating said combustion starter and said charge to be detonated, said delay element being an element according to claim 1.

15. The detonation delay device of claim 1 including non-electric means for igniting said starter.

16. The detonation delay device of claim 14 including electric means for igniting said starter.

* * * * *